US006056383A

United States Patent [19]

Banicevic et al.

[11] Patent Number: 6,056,383

[45] Date of Patent: May 2, 2000

[54] REFRIGERATOR CABINET BREAKER ASSEMBLY

[75] Inventors: Nedo Banicevic, Hamilton; Murray Klaas, Burlington, both of Canada

[73] Assignee: Camco Inc., Mississauga, Canada

[21] Appl. No.: 09/025,134

[22] Filed: Feb. 17, 1998

[30] Foreign Application Priority Data

May 29, 1997 [CA] Canada ..... 2206508

[51] Int. Cl.[7] ..... A47B 96/04

[52] U.S. Cl. ..... 312/406; 312/401; 312/406.2; 312/405; 49/DIG. 1

[58] Field of Search ..... 312/116, 236, 312/296, 401, 405, 406, 406.1, 406.2; 49/501, DIG. 1

[56] References Cited

U.S. PATENT DOCUMENTS

| | | | |
|---|---|---|---|
| 3,633,783 | 1/1972 | Aue | 220/9 G X |
| 3,635,536 | 1/1972 | Lackey et al. | 312/214 X |
| 4,056,211 | 11/1977 | Zumwalt | 220/9 |
| 4,118,451 | 10/1978 | Schauss | 264/46.5 X |
| 4,120,550 | 10/1978 | Sherburn | 312/296 |
| 4,134,626 | 1/1979 | Kordes | 312/214 X |
| 4,134,627 | 1/1979 | Kuskowski | 312/214 |
| 4,469,383 | 9/1984 | Losert | 312/296 |
| 4,558,503 | 12/1985 | Wilson | 29/446 |
| 4,606,112 | 8/1986 | Jenkins et al. | 29/464 |
| 4,644,698 | 2/1987 | Gerdes et al. | 49/478 |
| 4,653,819 | 3/1987 | Swerbinsky | 312/296 |
| 4,732,432 | 3/1988 | Keil et al. | 312/214 X |
| 4,834,471 | 5/1989 | Pasqualini | 312/214 |
| 4,974,914 | 12/1990 | Jenkins | 312/214 |
| 5,117,587 | 6/1992 | Doan | 49/495 |
| 5,255,531 | 10/1993 | Williams et al. | 62/277 X |
| 5,289,657 | 3/1994 | Kiel | 49/478.1 |
| 5,368,381 | 11/1994 | Mandel | 312/406.2 |
| 5,476,318 | 12/1995 | Yingst et al. | 312/401 |
| 5,551,192 | 9/1996 | Avendano et al. | 49/484.1 |
| 5,584,551 | 12/1996 | Jenkins | 312/401 |
| 5,645,330 | 7/1997 | Artwohl et al. | 312/116 |
| 5,720,536 | 2/1998 | Jenkins et al. | 312/406.2 |
| 5,725,294 | 3/1998 | Froelicher | 312/401 |
| 5,915,805 | 6/1999 | Lee | 312/405 |

*Primary Examiner*—Lynne H. Browne
*Assistant Examiner*—Brian H. Buck

[57] ABSTRACT

A refrigerator cabinet construction is disclosed where a breaker strip interconnects an exterior cabinet shell with an interior liner. The exterior cabinet shell has an open side and a shell edge flange. The interior liner is to fit within the exterior cabinet shell and has a liner flange extending outwardly of said liner. The breaker strip includes an exterior wall with first and second ended flanges. The breaker strip includes a first interior wall and a second interior wall projecting inwardly from said exterior wall to define a first channel. The first interior wall has a first flange co-extending with the first end flange of the exterior wall to define a shell receiving channel, wherein the shell edge flange is inserted into the shell receiving channel. A third interior wall is connected to second exterior wall and coextends with the second end flange of the exterior wall to define a liner receiving channel into which the liner flange extends. The third interior wall is joined through a hinge to a hinged flange adapted to pivot about the hinge and engage the liner flange and the liner during foaming to locate the liner flange in the liner receiving channel against the second end flange of the exterior wall. A magnetic strip is disposed in the first channel. The use of the hinged flange part of the breaker strip provides the advantage of having the breaker strip secure the outer shell relative to the liner while at the same time thermally insulating the outer casing shell from the inner liner.

18 Claims, 8 Drawing Sheets

26
12
32
32
32
32
32
16
34
36
28
40
38
40
30
34
36
18
34
14
34

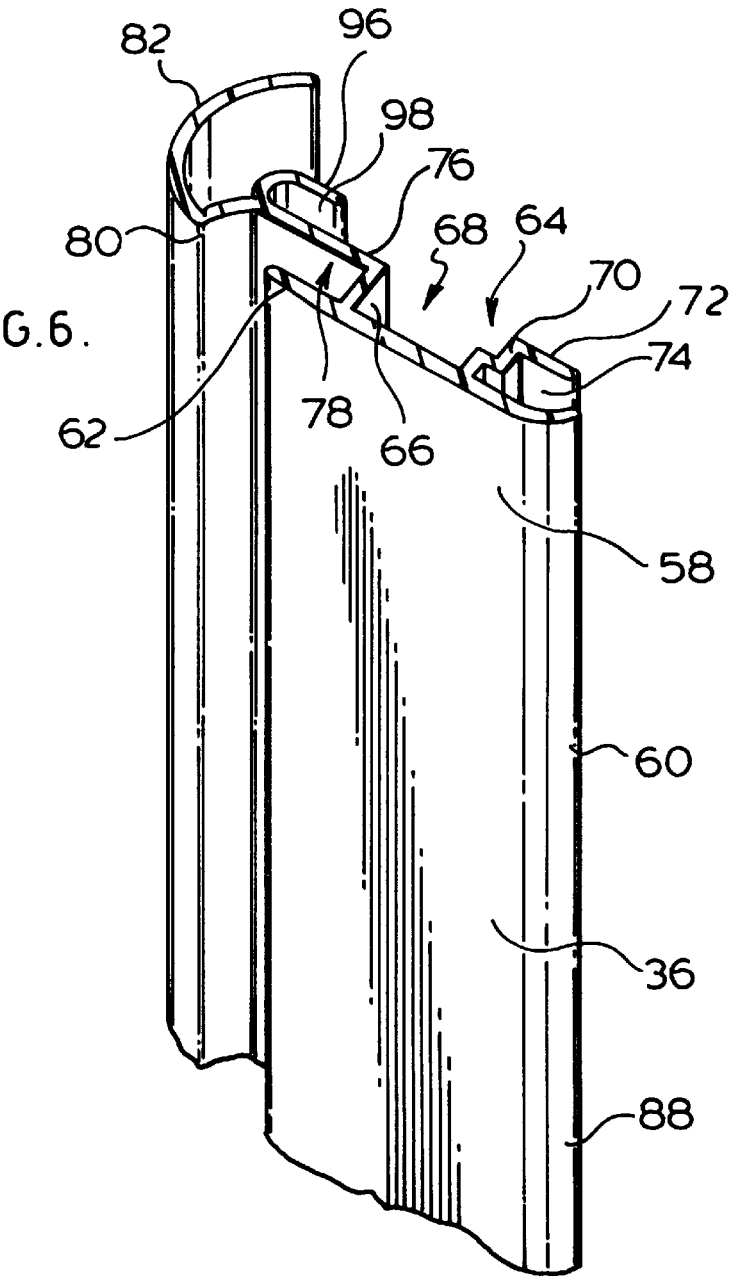
FIG. 6.
FIG. 7.
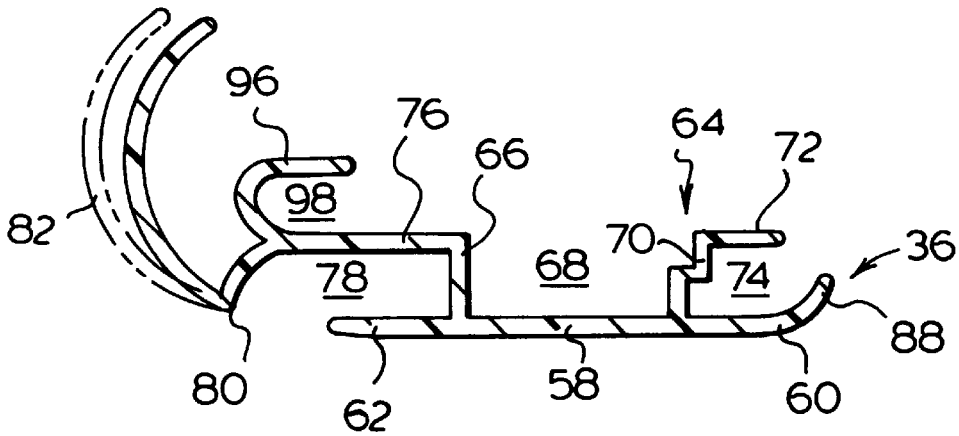

REFRIGERATOR CABINET BREAKER ASSEMBLY

TECHNICAL FIELD OF THE INVENTION

The present invention relates to the construction for a refrigerator cabinet. In particular the invention relates to a breaker strip used to attach an interior liner to the exterior cabinet shell during assembly.

BACKGROUND OF THE INVENTION

Domestic refrigerators and freezers are constructed typically with an exterior cabinet shell generally made from metal having an open side into which a plastic liner is assembled. The liner is typically made of plastic and is adapted to fit within and spaced from the exterior cabinet shell. The liner defines the food storage compartments of the refrigerator. Foam-in-place insulation is blown into the space between the liner and exterior cabinet shell. The foam-in-place has an adhesive characteristic which secures the liner and exterior cabinet shell together when the foam-in-place cures. It is common practice to use a breaker strip to interconnect the front faces of the interior liner and the exterior cabinet shell prior to foaming. The breaker strip holds the liner in spaced apart relation to the cabinet shell while the insulating material is inserted between them. Other forming supports are usually required to hold the plastic inner liner relative to the outer cabinet shell during the foaming operation.

U.S. Pat. No. 5,368,381 issued Nov. 29, 1994 to Sheldon Mandel shows a breaker strip used in a refrigerator to hold an inner plastic liner against the outer shell of the refrigerator cabinet without the requirement of additional supports or foam-in-place material. The breaker strip has a recess between two fingers for receiving the door liner and also a chamber for receiving a magnet. The breaker strip further includes a pair of spaced apart legs made of a resilient material which can extend into the exterior cabinet shell and frictionally engage the cabinet shell so that the breaker strip is held in place without the use of foam-in-place material. While this patent teaches positively locating the breaker strip relative to the cabinet shell prior to foaming-in-place the insulation, it may be difficult to remove the liner during the assembly operation should the liner not perfectly fit into the shell or require slight modifications during construction. The problem with positively locating the breaker strip is that it cannot be easily removed for slight modifications.

While many types of breaker strips are known in the art and have various means to engage the inner liner in the exterior cabinet shell, these breaker strips typically including foaming the breaker strip to engage the flanges of the liner and the exterior cabinet. However, in many cases the securing of the liner, breaker strip and exterior cabinet wall does not become secure until such time as the foam-in-place material is inserted.

Accordingly, there is a need for a breaker strip which can provide temporary assembly of the inner liner relative to the exterior cabinet shell permitting modifications to the cabinet construction when necessary prior to foaming the cabinet in place.

SUMMARY OF THE INVENTION

The present invention is directed towards the use of a novel breaker strip for use in association with a refrigerator cabinet shell and a cabinet liner. In particular, the construction of the present invention provides for a hinged flanged mechanism associated with the breaker strip which is adapted to force the liner into engagement with a liner receiving channel in the breaker strip when foam-in-place is inserted. The hinged flange causes the breaker strip to contact the liner at two locations. The first location is where the hinged flange abuts or touches the liner wall. The second location is where the hinge joint of the breaker touches or contacts the liner flange inserted into the breaker recess. Together the two points of engagement provide an effective seal against the escape of foam between the breaker strip and liner wall during the foaming operation. Prior to foaming, however, the natural outwardly extending forces associated with the liner forces the liner into the breaker receiving strip. There is also relative movement permitted between the breaker strip liner receiving channel and the liner prior to the foam-in-place operation so that any minor adjustments during manufacture may be made. Another novel aspect of the construction of the breaker strip is a rolled back channel in a shell edge flange such that the edge flange of the exterior cabinet shell extends back along behind the breaker strip reinforcing the breaker strip from any inward forces associated with door closing and at the same time providing an effective edge seal engagement between the breaker strip and the external cabinet shell of the refrigerator. The breaker strip further provides a thermal break between the interior liner and the exterior cabinet shell.

In accordance with one aspect of the present invention there is provided a refrigerator cabinet construction comprising an exterior cabinet shell having an open side and a shell edge flange extending around the open side. The cabinet construction includes an interior liner adapted to fit within the exterior cabinet shell and having a liner flange extending outwardly of the liner. The cabinet construction further includes a breaker strip interconnecting the interior liner with the exterior cabinet shell. The breaker strip includes an exterior wall having first and second end flanges and a first interior wall and a second interior wall projecting inwardly from the exterior wall defining a first channel. The first interior wall has a first flange co-extending with the first end flange of the exterior wall to define a shell receiving channel, wherein the shell edge flange is inserted into the shell receiving channel. A third interior wall is connected to the second interior wall and co-extends with the second end flange of the exterior wall to define a liner receiving channel into which the liner flange extends. The third interior wall is joined through a hinge to a hinged flange adapted to pivot about the hinge and engage the liner flange and the liner during foaming to fixedly locate the liner flange in the liner receiving channel against the second end flange of the exterior wall. The breaker further includes a magnet disposed in the first channel.

In a preferred aspect of the present invention, the hinged flange is curved to receive foam and cause the hinged flange to pivot about the hinge whereby the curved hinged flange engages the liner wall and the hinge engages the liner flange.

Lateral movement of the shell edge flange into the shell receiving channel is limited by the first interior wall and relative movement is permitted prior to foaming-in-place. Preferably, the first interior wall has a stepped outwardly wall portion that is spaced from the magnetic door closing strip. The stepped outwardly wall portion limits lateral movement of the shell edge flange relative to the breaker strip.

The first end flange preferably extends further than the first flange and the first end flange includes a rounded corner which engages the shell edge flange of the exterior cabinet shell.

In a preferred aspect of the present invention, the shell edge flange of the exterior cabinet shell has outer and inner legs defining a breaker receiving channel therebetween, wherein the outer leg is inserted into the shell receiving channel and the first flange of the first interior wall is inserted into the breaker receiving channel. The inner leg of the shell edge flange of the exterior cabinet shell extends along the first flange and the third inner wall to close the first channel housing the magnet. The double flange channel assembly provides for a reinforced shell to breaker strip where the forces exerted against the breaker strip during door closure are transferred through the breaker strip to the underlying edge flange of the exterior cabinet shell. Further, the underlying edge flange of the exterior cabinet wall is cantilevered allowing some "play" to compensate for manufacturing tolerances in the liner, breaker strip and exterior cabinet shell during assembly.

The third interior wall preferably includes a turned back flange defining a second shell receiving channel between the turned back flange and the third interior wall into which is inserted an end portion of the inner leg of the shell edge flange. The end portion of the inner leg overlies an end portion of the liner flange and the third interior wall of the breaker strip providing a structural interface supporting the liner flange relative to the inner leg of the exterior cabinet shell. Consequently, loading forces placed on the liner are transferred through the third interior wall of the breaker strip back to the underlying inner leg of the edge flange of the exterior cabinet shell.

In accordance with another aspect of the present invention there is provided a refrigerator cabinet construction comprising an exterior cabinet shell having an open side and a shell edge flange extending around the open side. The shell edge flange has outer and inner legs projecting inwardly which define a breaker receiving channel therebetween. The cabinet construction further includes an interior liner adapted to fit within the exterior cabinet and has an outwardly extending liner flange. The cabinet includes a breaker strip interconnecting the interior liner with the exterior cabinet shell. The breaker strip comprises an exterior wall having first and second end flanges. The breaker includes a first interior wall and a second interior wall projecting inwardly from the exterior wall defining a first channel. The first interior wall has a first flange co-extending with the first end flange of the exterior wall to define a shell receiving channel, wherein the outer leg of the shell edge flange is inserted into the shell receiving channel and the first flange of the first interior wall is inserted into the breaker receiving channel. The breaker strip includes a third interior wall connected to the second interior wall and co-extending in flush overlapping relation with the inner leg of the shell edge flange of the exterior cabinet shell, the third interior wall being spaced from the second end flange of the exterior wall to define a liner receiving channel into which the liner flange of the interior liner extends. The third interior wall extends into contact with the liner flange to provide a structural interface supporting the liner flange against the second end flange and relative to the inner leg of the shell edge flange. The breaker strip further includes a magnet disposed in the first channel.

BRIEF DESCRIPTION OF THE DRAWINGS

A more complete understanding of the nature of the present invention may be obtained by reference to the following detailed description when taken in conjunction with the accompanying diagrammatic drawings wherein:

FIG. 6 is a perspective view of the breaker strip employed by the present invention;

FIG. 7 is a sectional view of the breaker strip of the present invention;

DETAILED DESCRIPTION OF EMBODIMENTS

Figure 1:
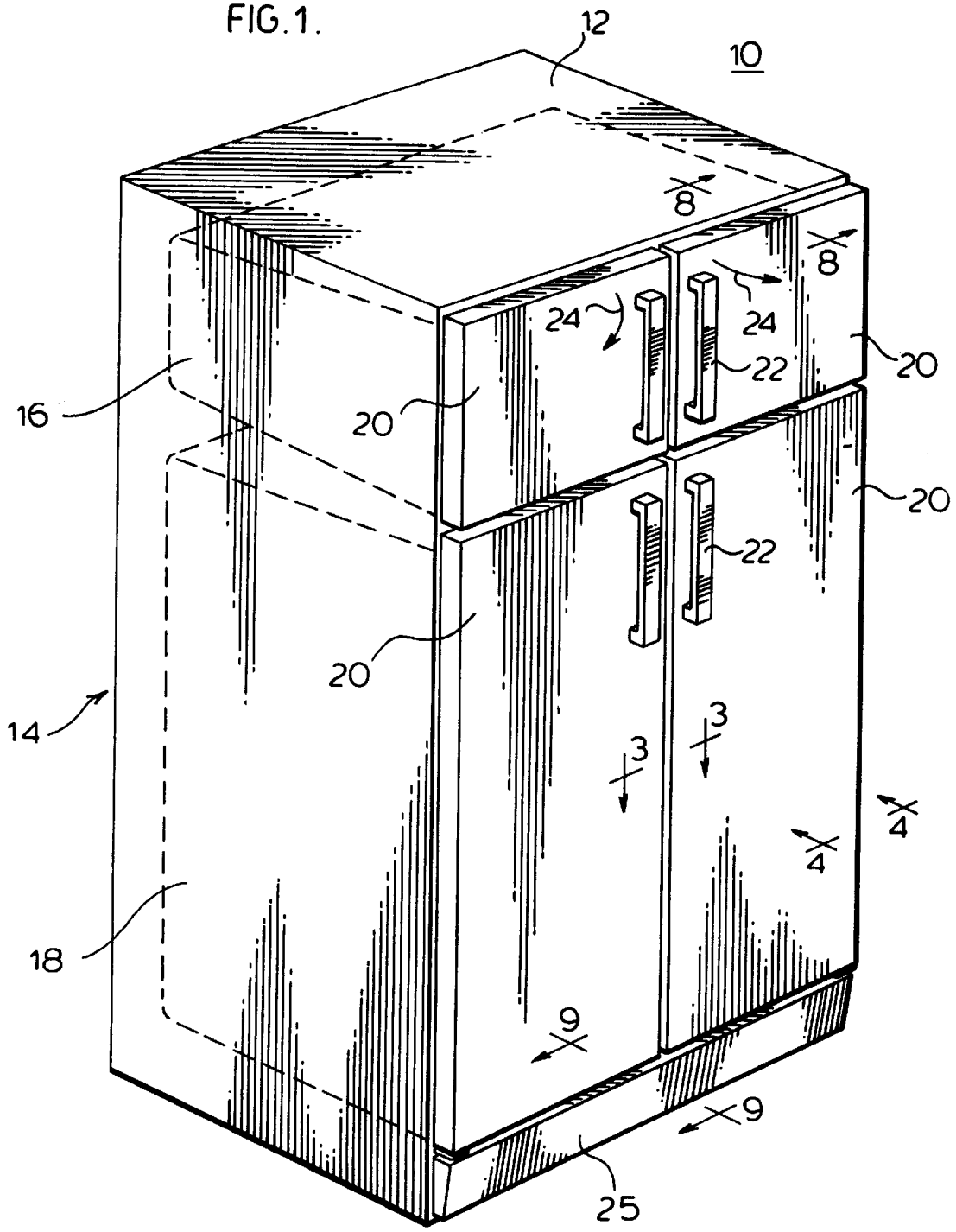
FIG. 1 is a perspective view of a refrigerator having side-by-side, or "French" doors.

Referring to FIG. 1, there is shown a domestic refrigerator 10 having an exterior cabinet shell 12. The refrigerator 10 includes an interior liner 14. Interior liner 14 includes two bubble sections providing an upper freezer compartment 16 and a lower fresh food compartment 18. Access to the freezer compartment 16 and the fresh food compartment 18 is permitted at the front of the refrigerator 10 by opening doors 20. Doors 20 have handles 22 which facilitate opening of the doors which swing open in the direction shown by arrows 24. The bottom of the refrigerator 10 has a decorative kick plate 25.

Figure 2:
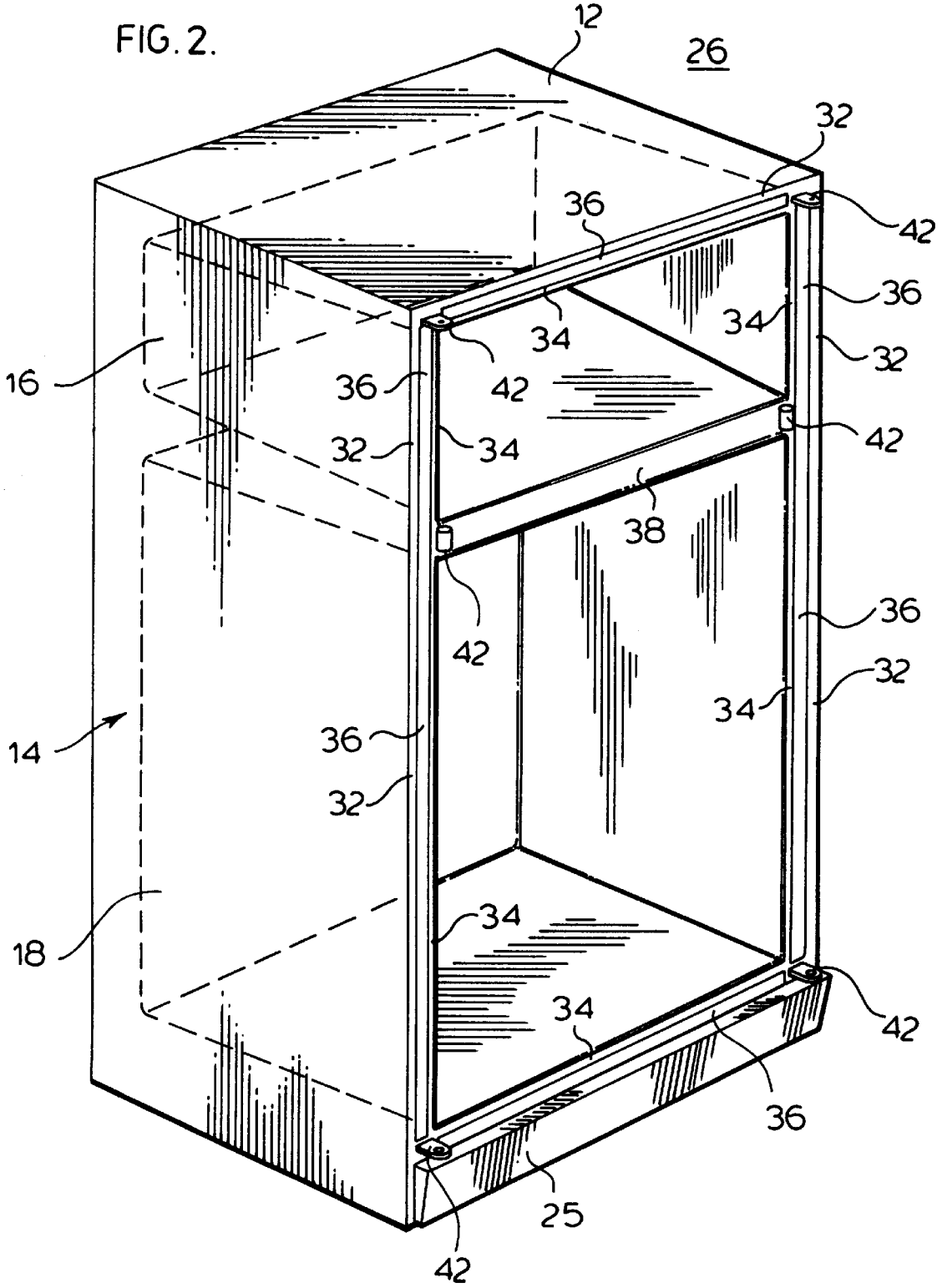
FIG. 2 is a perspective view of the refrigerator cabinet of the present invention with the doors removed.
Figure 3:
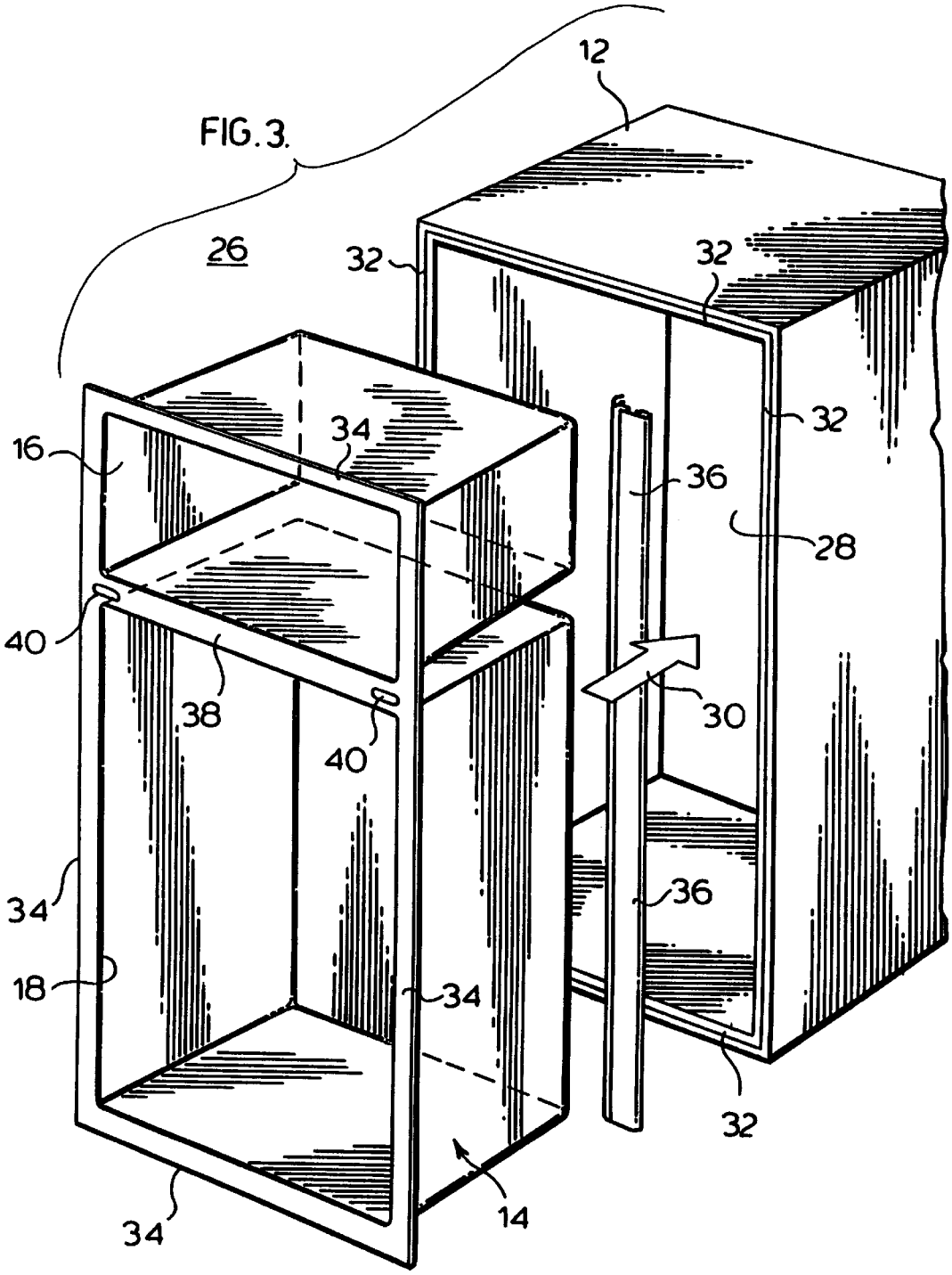
FIG. 3 is an exploded view of the refrigerator cabinet showing the interior bubble plastic liner, the breaker strip and the exterior cabinet shell.

Referring to FIGS. 2 and 3, the general construction of the refrigerator cabinet 26 is shown. In FIG. 2, cabinet 26 is shown without the attachment of doors 20. The assembly of the cabinet is shown in FIG. 3 prior to the insertion of the interior liner 14 into open side 28 of exterior cabinet shell 12. This insertion is represented by arrow 30.

The exterior cabinet shell 12 has a shell edge flange 32 extending around the open side and in towards the opening of the open side 28. The exterior cabinet shell 12 is made from sheet metal.

The interior liner 14 is adapted to fit within the exterior cabinet shell 12. The interior liner includes a liner flange 34 extending outwardly of said liner. The liner flange 34 is shown to extend outwardly of the top, bottom and side walls of the liner 14. The liner 14 is a plastic material made from a mold.

A breaker strip 36 interconnects the interior liner 14 with the exterior cabinet shell 12. In FIG. 3, only one breaker strip is shown for one side wall. It should be understood that breaker strips are provided between the liner flange 34 and the shell edge 32 along the top, bottom and side walls of the refrigerator.

The liner 14 has a mullion 38. Also the liner has openings 40 through which hinges 42 (see FIG. 2) extend for the mounting of the refrigerator doors 20. The hinges 42 are secured by additionally supporting brackets (not shown) fastened to the exterior cabinet shell of the refrigerator. The location of the hinges 42 at the exterior cabinet shell can interrupt the extension of the breaker strip. However, it should be understood that the hinges may be located through the shell edge flange 32 closer to the exterior cabinet shell 12 so that the breaker strip 36 is uninterrupted.

The breaker strip 36 shown in FIGS. 2 and 3 of the drawings is of a novel construction which provides an advantage of allowing the interconnection of the interior liner 14 to the exterior cabinet shell 12 prior to foaming that permits for minor assembly adjustments.

Figure 4:
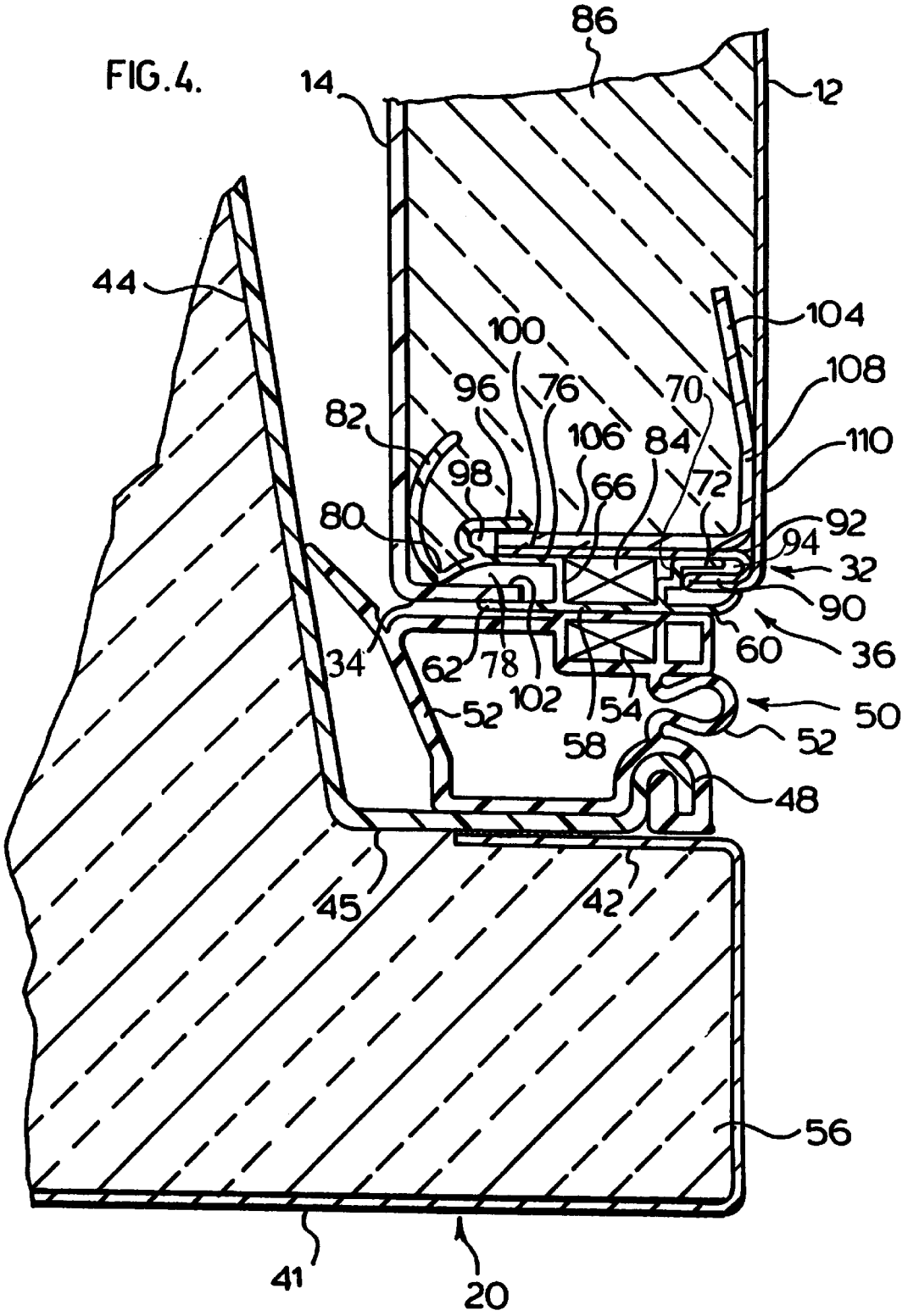
FIG. 4 is a sectional view as seen at section 4—4 of FIG. 1 of the refrigerator showing the cabinet construction of the present invention along a front side wall of the refrigerator.
Figure 5:
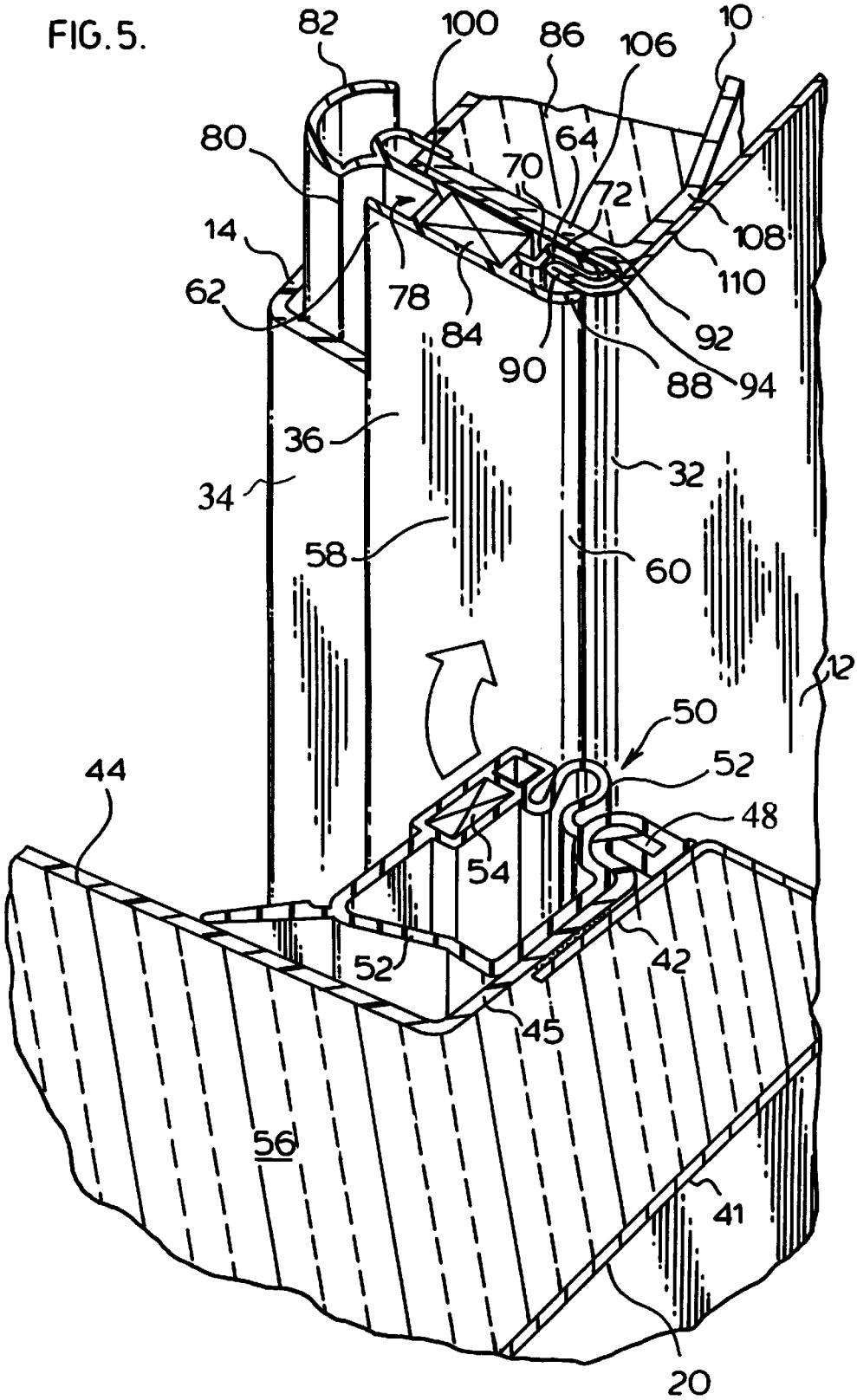
FIG. 5 is an enlarged partially broken away perspective view of the refrigerator cabinet construction of the present invention as shown in FIG. 4.

Referring to FIG. 4, there is shown a sectional view of the breaker strip 36 of the present invention. Also, reference may be made to FIG. 5 which shows a view similar to FIG. 4 and is an isomeric view showing the door 20 in an open position.

The door 20 is shown to comprise an exterior shell 41 having an inturned flange 42. The inside of the door is provided with a door liner 44 having an outwardly turned flange 45. The outwardly turned flange 45 is provided with a hook 48 for effecting a clasping motion with a door sealing gasket generally at 50. The gasket 50 is provided with a web 52 which holds a magnet 54. Within the door 20 is foam 56. It should be understood that the construction of the door and its associated seal 50 forms no part of the present invention.

Referring now to FIGS. 6 and 7 in addition to 4 and 5, the construction of the breaker strip 36 can be seen. Breaker strip 36 includes an exterior wall 58 having first end flange 60 and a second end flange 62. The purpose of exterior wall 58 is to provide a relatively flat surface against which the gasket 50 engages to provide an effective seal against exterior wall 58.

The breaker strip 36 further includes a first interior wall 64 and a second interior wall 66 projecting inwardly of the exterior wall 58 to define a first channel 68 between walls 64 and 66. The first interior wall 64 has a stepped out wall portion 70 relative to the first channel 68. The first interior wall 64 further includes a first flange 72 which co-extends with the first end flange 60 of the exterior wall 58 to define a shell receiving channel 74. The end of the first end flange 60 is shown to be curved at 88 so as to overlap and engage the edge flange 32 which can be inserted into the shell receiving channel 74.

Lateral motion of the shell edge flange 32 is limited by the step wall portion 70 of the first interior wall 64. The shell edge flange 32 is shown in FIG. 4 to include an outer leg 90 and an inner leg 92 defining a breaker receiving channel 94 between these legs. The outer leg 90 is inserted into the shell receiving channel 74 and the first flange 72 of the first interior wall 64 is inserted into the breaker receiving channel 74. This effectively provides for a double channel, double flange locking action which assists in the reinforcement and strengthening of breaker strip 36 connection to the exterior cabinet shell 12.

The breaker strip 36 is provided with a third interior wall 76 connected to the second interior wall 68 and co-extending with the second end flange 62 of the exterior wall 12 to define a liner receiving channel 78. The liner flange 34 extends into the liner receiver channel 78. The third interior wall 76 is joined through a hinge 80 to a hinged flange 82. Hinged flange 82 is a curved flange that is adapted to pivot about the hinge 80 and engage both the liner flange 34 and the liner 14 during foaming to fixedly locate the liner flange 34 in the liner receiving channel 78 against the second end flange 62 of the exterior wall 58. This hinging feature is another aspect of the present invention which provides for both a reinforcing and a locating sealing arrangement between the breaker strip 36 and the inner liner 14 of the refrigerator when foam 86 is inserted into the walls of the refrigerator.

The breaker strip 36 is further provided with a turned back flange 96 which extends from the third interior wall 76. The turned back flange 96 with the interior wall 76 defines a second shell receiving channel 98 into which can be inserted an end portion 100 of the inner leg 92 of the shell edge flange 32. This also effectively assists in reinforcing the shell edge flange with the breaker strip 36. The inner leg 92 accordingly extends across the first channel opening 68 to close this opening and positively locate the magnetic strip 84 within the first channel 72 extending along the length of the breaker strip 36. Because the first channel opening 68 is "open", the magnetic strip 84 can be inserted through the opening into the strip without having to be slid along the entire length of the channel 68. The magnetic strip 84 is used to close the refrigerator doors 20 by attracting magnet 54 in gasket 50 to maintain gasket 50 sealed against exterior wall 58 of breaker strip 36.

Referring the FIG. 4, the first end portion 100 of the inner leg 92 overlies an end portion 102 of the liner flange 34. The third interior wall 76 of the breaker strip 36 provides a structural interface supporting the liner flange 34 relative to the inner leg 92 which forms a portion of the shell edge flange 32 of the exterior cabinet shell 12. Hence, reinforcement and structural support between the exterior cabinet shell 12 and the interior liner 14 is provided in a thermal break fashion by the breaker strip 36. It should be understood that the breaker strip 36 is of suitable plastic construction and provides for effective insulation between parts.

FIG. 4 further shows an angled reinforcing member 104 located within the wall of the refrigerator. The angled reinforcing member 104 has a first side 106 which co-extends with the first inner leg 92 of the shell edge flange 32 and is adapted to be inserted into the second shell receiving channel 98. The reinforcing member 104 further includes a second side 108 that lies substantially flush with the wall portion 110 of the exterior cabinet shell 12. During the foaming operation, the reinforcing member 104 is forced against the wall portion 110 of the exterior cabinet shell 12 and against the breaker strip 14 so as to effectively include another mechanism for reinforcing the angled connection of the exterior cabinet shell 12 with the breaker strip 36.

Figure 8:
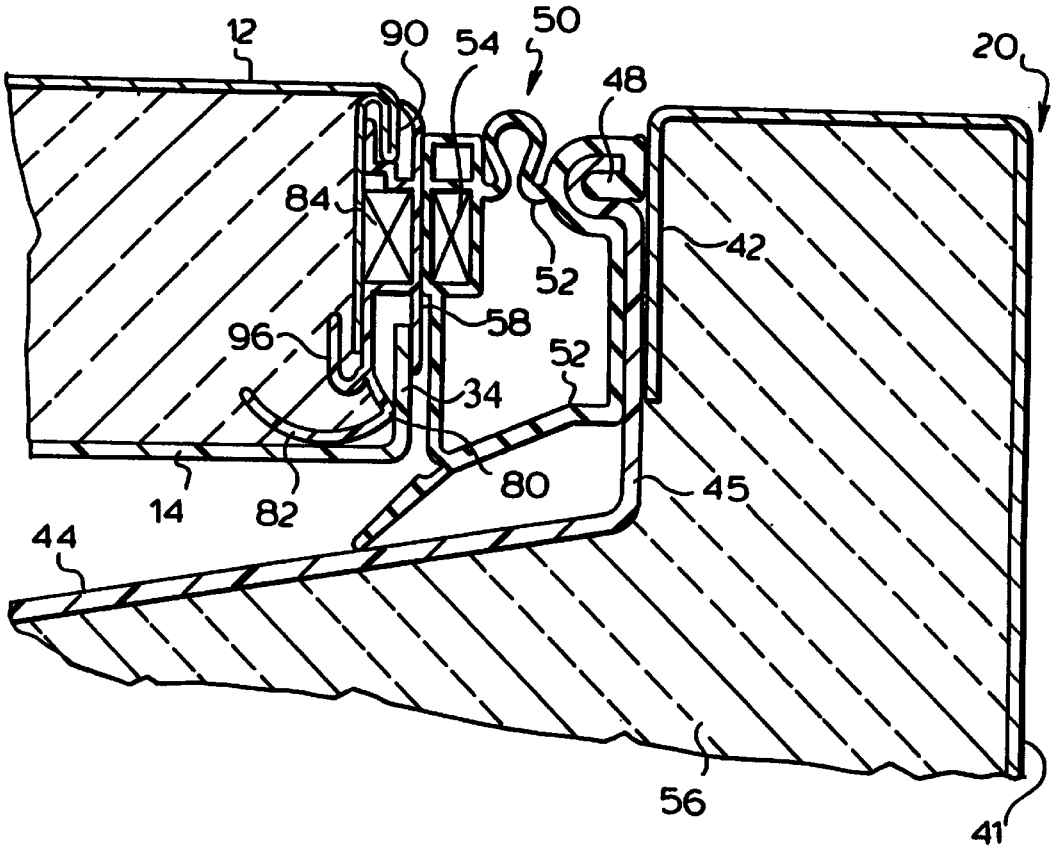
FIG. 8 is a sectional view as seen at section 8—8 of FIG. 1 of the refrigerator cabinet construction along the front top wall of the refrigerator; and, FIG. 9 is a sectional view as seen at section 9—9 of FIG. 1 of the refrigerator cabinet construction along the front bottom wall of the refrigerator.

Referring to FIG. 8, there is shown a sectional view as seen at section 8—8 of FIG. 1 of the refrigerator cabinet construction along the front top wall of the refrigerator. In this construction, the construction of the breaker strip 36 relative to the inner liner 14 and the exterior cabinet shell 12 is substantially the same as that described for FIG. 4. The only difference is the angled reinforcing member 104 is not included.

Figure 9:
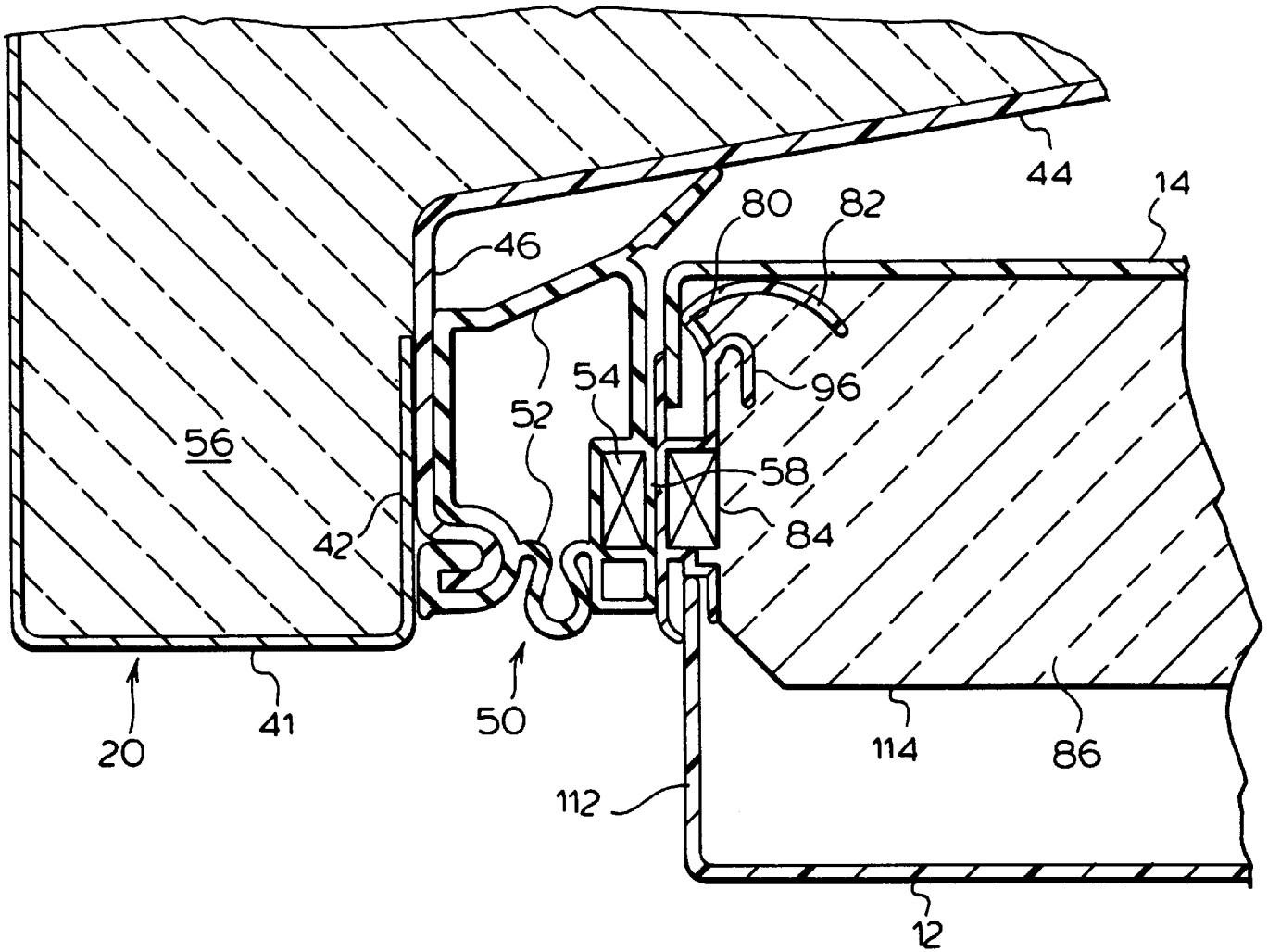

Referring now to FIG. 9, there is shown a sectional view as seen at 9—9 of FIG. 1 of the refrigerator cabinet construction along the front bottom wall of the refrigerator. As can be seen, the exterior cabinet shell 12 includes a straight shell edge flange 112 which is inserted into the shell receiving channel 74 of the breaker strip 36. In order to ensure that foam-in-place insulation 86 is not filling up areas where it is not necessary, an additional metal liner 114 is included along the bottom of the refrigerator and this metal liner 114 is forced against the first flange 72 of the first interior wall 64 of the breaker strip 36. It should be understood that the edge of flange 114 could also be bent and hooked so that it could also extend into the shell receiving channel 74.

What is claimed is:

1. A refrigerator cabinet construction comprising:

(a) an exterior cabinet shell having an open side and a shell edge flange extending around the open side;

(b) an interior liner adapted to fit within the exterior cabinet shell and having a liner flange extending outwardly of said liner;

(c) an integrally molded breaker strip interconnecting the interior liner with the exterior cabinet shell, the breaker strip comprising:

(i) an exterior wall having first and second end flanges, (ii) a first interior wall and a second interior wall projecting inwardly from said exterior wall defining a first channel;

(iii) said first interior wall having a first flange co-extending with said first end flange of said exterior wall to define a shell receiving channel, wherein the shell edge flange is inserted into the shell receiving channel;

(iv) a third interior wall connected to said second interior wall and co-extending with said second end flange of the exterior wall to define a liner receiving channel into which the liner flange extends, and said third interior wall joined through a hinge to a hinged flange adapted to pivot about the hinge and engage said liner flange and said liner during foaming to fixedly locate said liner flange in said liner receiving channel against said second end flange of said exterior wall; and, (v) a magnet disposed in the first channel.

2. The refrigerator cabinet of claim 1 wherein said hinged flange is curved to receive foam and cause the curved hinged flange to pivot about said hinge whereby the curved hinged flange engages the liner wall and the hinge engages the liner flange.

3. The refrigerator cabinet of claim 1 wherein lateral movement of said shell edge flange into said shell receiving channel is limited by said first interior wall.

4. The refrigerator cabinet construction of claim 3 wherein said first interior wall has a stepped wall portion.

5. The refrigerator cabinet construction of claim 1 wherein said first interior wall has a stepped outwardly wall portion that is spaced from said magnet, said stepped outwardly wall portion limiting lateral movement of said shell edge flange relative to the breaker strip.

6. The refrigerator cabinet of claim 1 wherein said first end flange extends further than said first flange, said first end flange including a rounded corner which engages the shell edge flange of said exterior cabinet shell.

7. The refrigerator of claim 1 wherein said shell edge flange of said exterior cabinet shell has outer and inner legs defining a breaker receiving channel therebetween, wherein said outer leg is inserted into said shell receiving channel and said first flange of said first interior wall is inserted into said breaker receiving channel.

8. The refrigerator cabinet of claim 7 wherein said inner leg of said shell edge flange of said exterior cabinet shell extends along the first flange and the third interior wall to close said first channel housing said magnet.

9. The refrigerator cabinet of claim 8 wherein said third interior wall includes a turned back flange defining a second shell receiving channel between the turned back flange and the third interior wall into which is inserted an end portion of said inner leg of said shell edge flange.

10. The refrigerator cabinet of claim 9 wherein said end portion of said inner leg overlies an end portion of said liner flange and said third interior wall of said breaker strip to support said liner flange relative to said inner leg of said exterior cabinet shell.

11. The refrigerator cabinet of claim 9 further including an angled reinforcing member having a first side co-extending with said inner leg of said shell edge flange and inserted into the second shell receiving channel and having a second side that lies substantially flush to a wall portion of the exterior cabinet shell.

12. A refrigerator cabinet construction comprising:

(a) an exterior cabinet shell having an open side and a shell edge flange extending around the open side, said shell edge flange having outer and inner legs projecting inwardly and defining a breaker receiving channel therebetween;

(b) an interior liner adapted to fit within the exterior cabinet and having an outwardly extending liner flange;

(c) a breaker strip interconnecting the interior liner with the exterior cabinet shell, the breaker strip comprising:

(i) an exterior wall having first and second end flanges, (ii) a first interior wall and a second interior wall projecting inwardly from said exterior wall defining a first channel;

(iii) a magnet disposed in the first channel;

(iv) said first interior wall having a first flange co-extending with said first end flange of said exterior wall to define a shell receiving channel, wherein the outer leg of said shell edge flange is inserted into the shell receiving channel and said first flange of said first interior wall is inserted into said breaker receiving channel and said first interior wall having a stepped outwardly wall portion that is spaced from said magnet, said stepped outwardly wall portion limiting lateral movement of said shell edge flange relative to the breaker strip; and (v) a third interior wall connected to said second interior wall and co-extending in flush overlapping relation with the inner leg of said shell edge flange of said exterior cabinet shell, said third interior wall being spaced from said second end flange of the exterior wall to define a liner receiving channel into which the liner flange of the interior liner extends, and said third interior wall extending into contact with the liner flange to support said liner flange against said second end flange and relative to said inner leg of the shell edge flange.

13. The refrigerator cabinet of claim 15 wherein said first end flange extends further than said first flange, said first end flange including a rounded corner which engages the shell edge flange as it extends into said shell receiving channel.

14. The refrigerator cabinet of claim 12 wherein said third interior wall ends at a hinge in a hinged curved flange adapted to move and engage the liner flange and the liner wall during foaming to force said liner flange into engagement with said second end flange of said exterior wall.

15. A refrigerator cabinet construction comprising:

(a) an exterior cabinet shell having an open side and a shell edge flange extending around the open side, said shell edge flange having outer and inner legs projecting inwardly and defining a breaker receiving channel therebetween;

(b) an interior liner adapted to fit within the exterior cabinet and having an outwardly extending liner flange;

(c) an integrally molded breaker strip interconnecting the interior liner with the exterior cabinet shell, the breaker strip comprising:

(i) an exterior wall having first and second end flanges, (ii) a first interior wall and a second interior wall projecting inwardly from said exterior wall defining a first channel;

(iii) said first interior wall having a first flange co-extending with said first end flange of said exterior wall to define a shell receiving channel, wherein the outer leg of said shell edge flange is inserted into the shell receiving channel and said first flange of said first interior wall is inserted into said breaker receiving channel;

(iv) a third interior wall connected to said second interior wall and co-extending in flush overlapping relation with the inner leg of said shell edge flange of said exterior cabinet shell, said third interior wall being spaced from said second end flange of the exterior wall to define a liner receiving channel into which the liner flange of the interior liner extends, and said third interior wall extending into contact with the liner flange to support said liner flange against said second end flange and relative to said inner leg of the shell edge flange, and said third interior wall having a turned back flange defining a second shell receiving channel between the turned back flange and the third interior wall into which is inserted an end portion of said inner leg of said shell edge flange; and, (v) a magnet disposed in the first channel.

16. The refrigerator cabinet of claim 15 wherein said inner leg of said edge flange of said exterior cabinet shell extends across the shell receiving channel housing said magnet.

17. The refrigerator cabinet of claim 15 wherein said end portion of said inner leg overlies an end portion of said liner flange.

18. The refrigerator cabinet of claim 14 further including an angled reinforcing member having a first side co-extending with said inner leg of said shell edge flange and inserted into the second shell receiving channel and having a second side that lies substantially flush to a portion of the exterior cabinet shell.

* * * * *